US008956174B2

(12) United States Patent
Raptis

(10) Patent No.: US 8,956,174 B2
(45) Date of Patent: Feb. 17, 2015

(54) ELECTRICAL RECEPTACLE HAVING LOCKING ELEMENTS AND A DIVIDER

(71) Applicant: Cerro Wire LLC, Hartselle, AL (US)

(72) Inventor: Gregory Raptis, Crothersville, IN (US)

(73) Assignee: Marmon Retail Home Improvement Products, Inc., Crothersville, IN (US)

( * ) Notice: Subject to any disclaimer, the term of this patent is extended or adjusted under 35 U.S.C. 154(b) by 0 days.

(21) Appl. No.: 13/746,613

(22) Filed: Jan. 22, 2013

(65) Prior Publication Data

US 2014/0057477 A1 Feb. 27, 2014

Related U.S. Application Data

(60) Provisional application No. 61/588,966, filed on Jan. 20, 2012.

(51) Int. Cl.

| | |
|---|---|
| ***H01R 13/625*** | (2006.01) |
| ***H01R 13/639*** | (2006.01) |
| ***H01R 13/635*** | (2006.01) |
| *H01R 103/00* | (2006.01) |
| *H01R 24/22* | (2011.01) |

(52) U.S. Cl.

CPC ..... *H01R 13/639* (2013.01); *H01R 13/635* (2013.01); *H01R 2103/00* (2013.01); *H01R 24/22* (2013.01)

USPC ..... 439/348

(58) Field of Classification Search

USPC ..... 439/345–348, 134, 270

See application file for complete search history.

(56) References Cited

U.S. PATENT DOCUMENTS

| | | | | |
|---|---|---|---|---|
| 3,836,947 | A | 9/1974 | Yeager | |
| 4,627,681 | A | 12/1986 | Hong | |
| 4,867,697 | A | 9/1989 | Borges | |
| 5,393,239 | A | 2/1995 | Ursich | |
| 5,551,884 | A * | 9/1996 | Burkhart, Sr. | 439/140 |
| 5,893,772 | A * | 4/1999 | Carmo et al. | 439/346 |
| 5,921,798 | A | 7/1999 | Ursich | |
| 5,941,724 | A | 8/1999 | Reed | |
| 6,171,129 | B1 | 1/2001 | Phillips | |
| 6,428,339 | B1 | 8/2002 | Davidson et al. | |

(Continued)

FOREIGN PATENT DOCUMENTS

| | | |
|---|---|---|
| CA | 2183600 A1 | 2/1998 |
| JP | 5205814 A | 8/1993 |
| WO | WO 2011/038395 | 3/2011 |

*Primary Examiner* — Chandrika Prasad

(74) *Attorney, Agent, or Firm* — R. Blake Johnston; DLA Piper LLP (US)

(57) ABSTRACT

A locking electrical receptacle includes a housing having a pair of openings and contains a pair of prong clips adapted to be connected to a source of electricity and to engage a pair of male prongs inserted through the pair of openings. A push button having a pair of locking surfaces, a pair of unlocking surfaces and a pair of ramp surfaces is positioned in the housing and extends out of the housing. A pair of locking elements are positioned within the housing and movable between a locked position, where the pair locking elements are adapted to lock a pair of male prongs inserted through the pair of openings in the housing, and an unlocked position, where the male prongs are unlocked and may be removed from the pair of openings. The pair of locking elements engage the pair of locking surfaces of the push button when in the locked position, the pair of unlocking surfaces when in the unlocked position and the pair of ramp surfaces when moving between the locked and unlocked positions.

32 Claims, 14 Drawing Sheets

(56) References Cited

U.S. PATENT DOCUMENTS

| | | | | |
|---|---|---|---|---|
| 6,545,810 | B1 | 4/2003 | Kenny | |
| 6,699,050 | B1 * | 3/2004 | Wong et al. | 439/148 |
| 6,805,572 | B1 * | 10/2004 | Lai | 439/348 |
| 7,172,451 | B1 * | 2/2007 | Ratzlaff | 439/346 |
| 7,182,615 | B1 | 2/2007 | Liu | |
| 7,320,613 | B1 * | 1/2008 | Ratzlaff | 439/345 |
| 7,798,838 | B2 * | 9/2010 | Grieff et al. | 439/346 |
| 7,901,250 | B2 | 3/2011 | Lam et al. | |
| 8,109,778 | B2 * | 2/2012 | Howard et al. | 439/346 |
| 8,357,001 | B2 * | 1/2013 | Katagiri et al. | 439/304 |

* cited by examiner

ELECTRICAL RECEPTACLE HAVING LOCKING ELEMENTS AND A DIVIDER

CLAIM OF PRIORITY

This application claims priority to U.S. Provisional Patent Application No. 61/588,966, filed Jan. 20, 2012, the contents of which are hereby incorporated by reference.

FIELD OF THE INVENTION

The present invention relates generally to female electrical receptacles for receiving the prongs of a male plug and, in particular, to a female electrical receptacle that automatically engages and locks the prongs of a male plug that are inserted therein and that may be manually actuated to release the prongs for removal of the male plug.

DETAILED DESCRIPTION OF EMBODIMENTS

Figure 1:
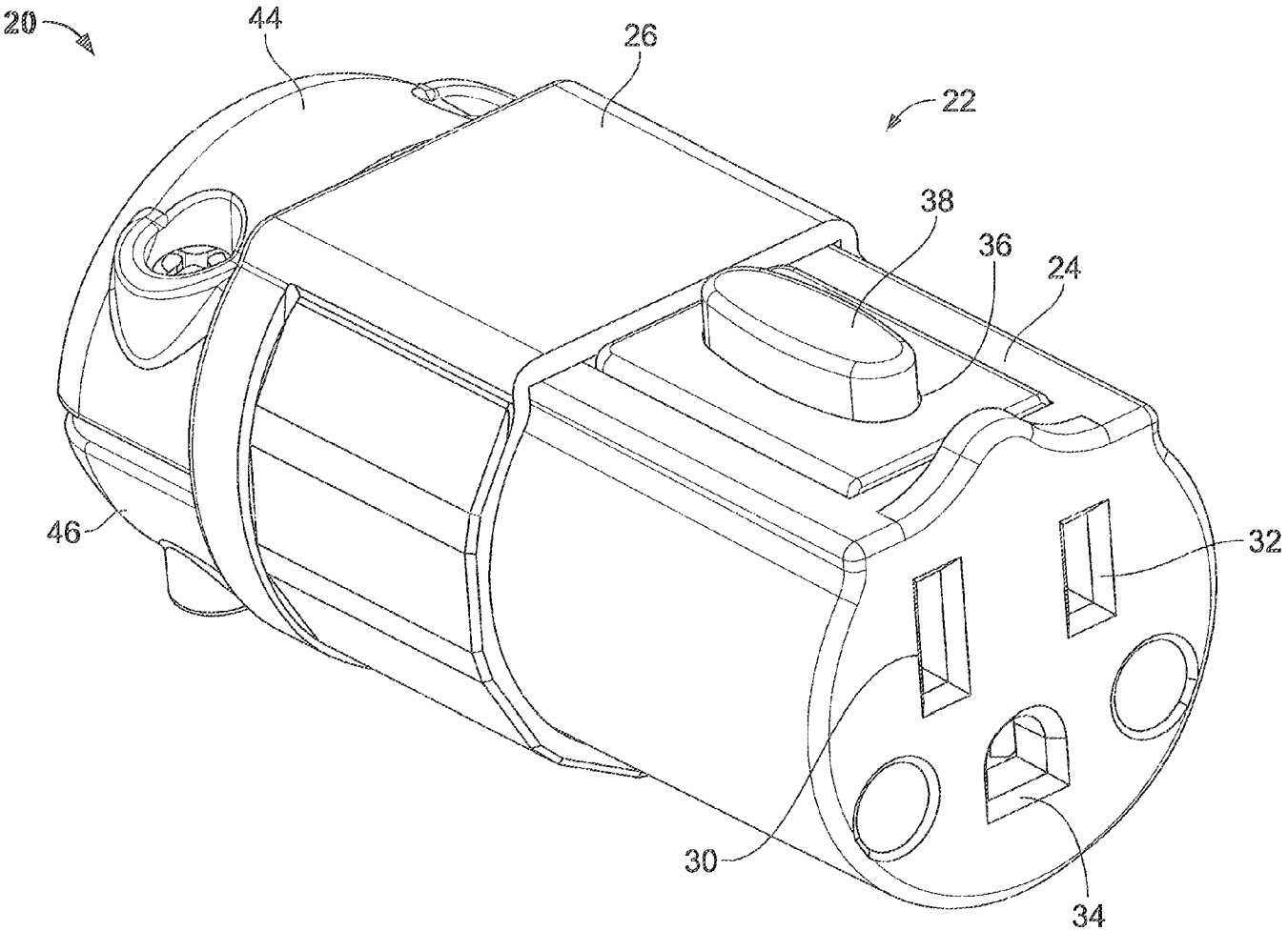
FIG. 1 is a front perspective view of an embodiment of the locking electrical receptacle of the invention.
Figure 2:
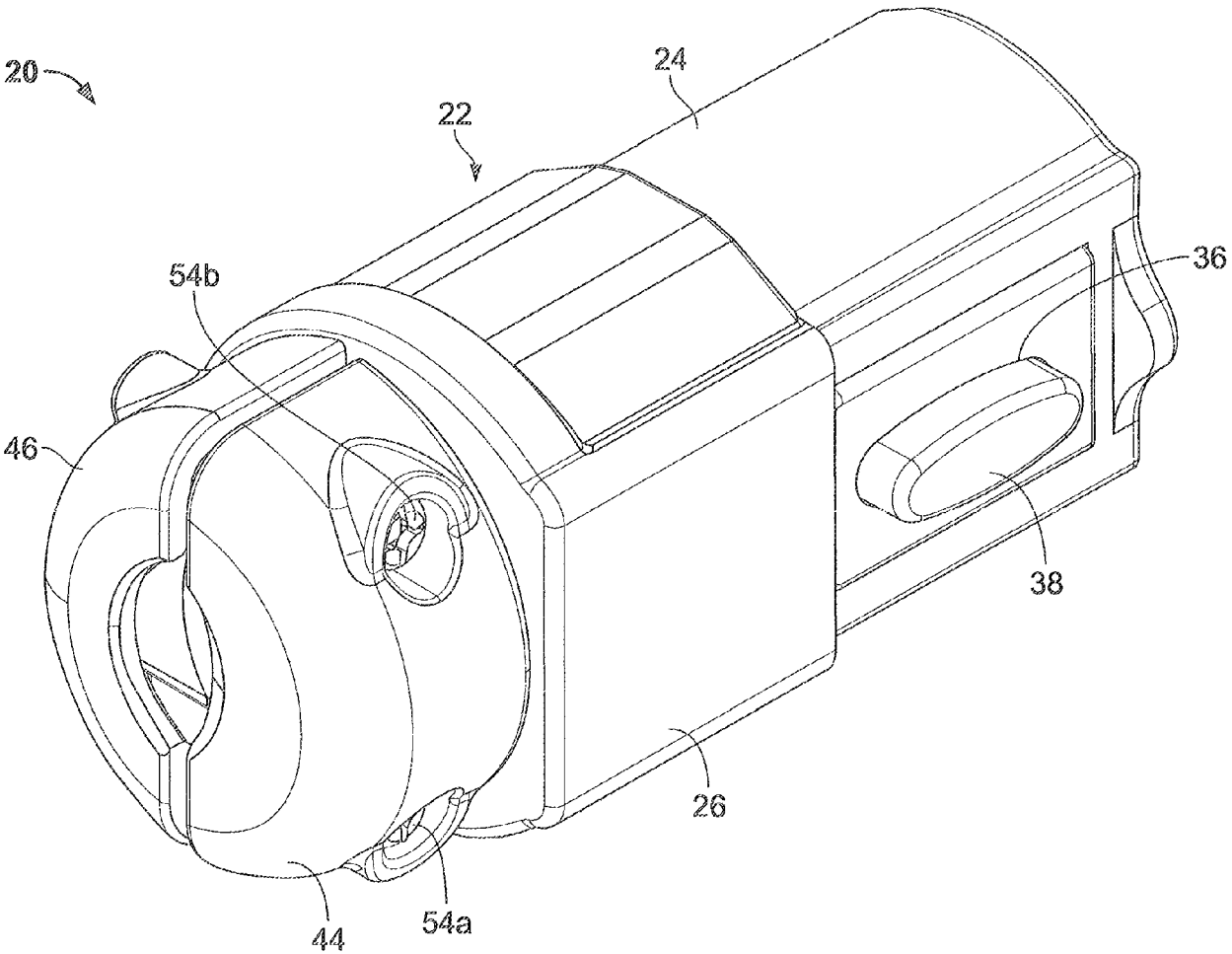
FIG. 2 is a rear perspective view of the locking electrical receptacle of FIG. 1.

An embodiment of the locking electrical receptacle of the present invention is indicated in general at 20 in FIGS. 1 and 2. This particular embodiment takes the form of a dead front that is mounted on an electrical cord, such as an extension cord or the like. It should be understood that the locking electrical receptacle of the invention could take the form of any electrical receptacle, including, but not limited to, a wall-mounted receptacle, a receptacle box mounted on the surface of a stud or a wall, a receptacle mounted to a machine, etc.

Figure 3:
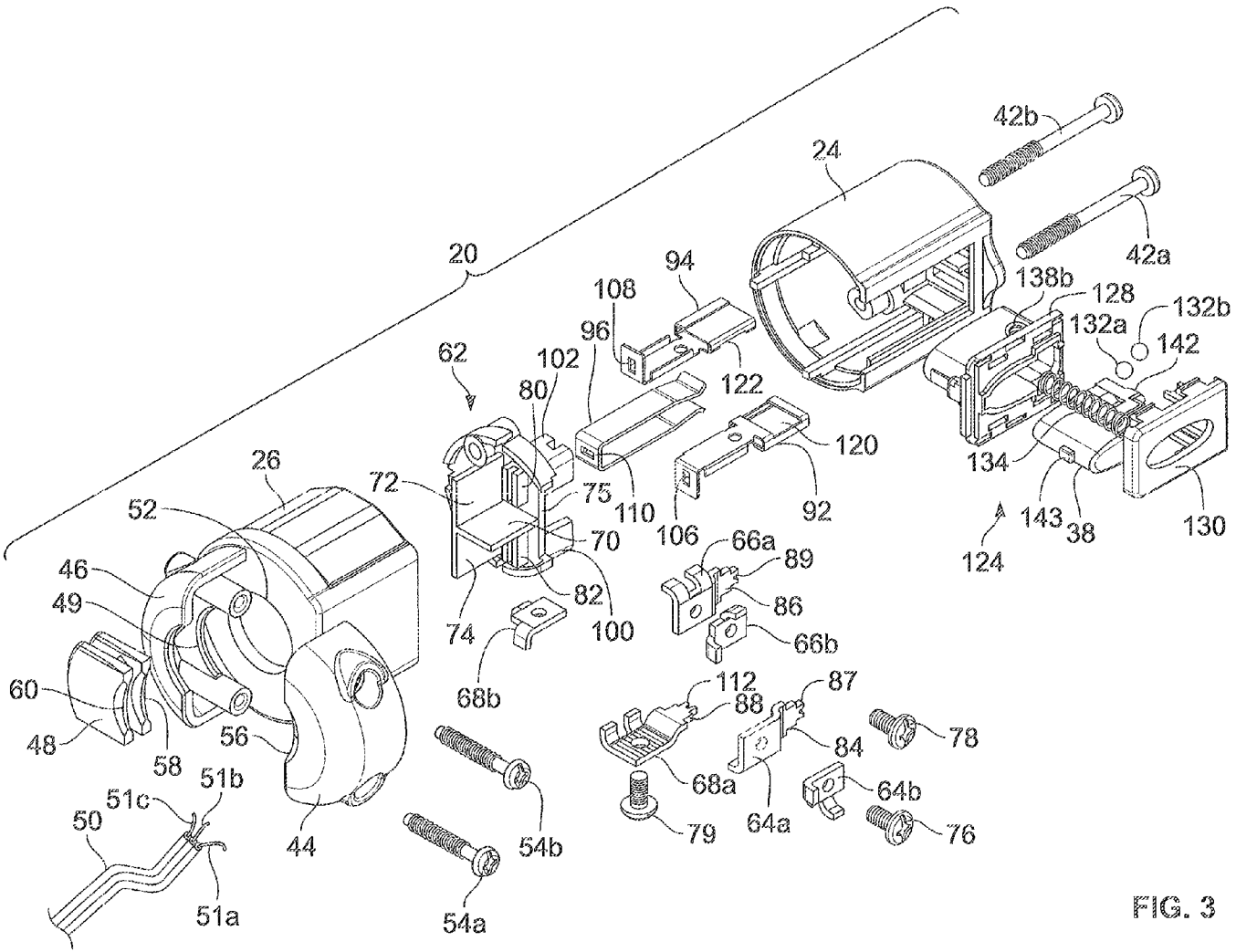
FIG. 3 is an exploded rear perspective view of the locking electrical receptacle of FIGS. 1 and 2.

With reference to FIGS. 1 and 2, the receptacle features a housing, indicated in general at 22, that includes a front shell 24 and a rear shell 26. As shown in FIG. 1, the front shell includes neutral prong opening 30, hot prong opening 32 and ground prong opening 34. The front shell also includes an opening 36 through which push button 38 passes. With reference to FIG. 3, the front and rear shells of the housing are held together by screws 42*a* and 42*b*. The front and rear shells of the housing are preferably constructed from plastic.

As also illustrated in FIG. 3, the housing includes a cord clamping assembly which features a generally C-shaped removable clamping member 44, a corresponding fixed clamping member 46 of the rear shell 26 as well as a bifurcated spacer plate 48. In use, spacer plate 48 is positioned on arc-shaped mounting surface 49 and an electrical cord 50 passes through the opening 52 of the rear shell 26. Removable clamping member 44 is then placed in engagement with the fixed clamping member 46 and screws 54*a* and 54*b* are used to secure the assembly with the cord engaged and secured by clamping surfaces 56 and 58 and 60. For larger diameter electrical cords, spacer plate 48 may be discarded and mounting surface 49 may be used as a clamping surface in cooperation with clamping surface 56.

Housing 22 defines an interior chamber that, with reference to FIG. 3, is divided into two sections by a divider, indicated in general at 62. Divider 62 is preferably constructed from molded plastic. The rear interior section houses metal contact plates 64*a* and 64*b*, 66*a* and 66*b*, and 68*a* and 68*b* and receives the end of the electrical cord upon which the receptacle is mounted. Divider 62 includes walls 70, 72 and 74 which, along with the divider main wall 75, define three compartments, one for each pair of contact plates. More specifically, contact plates 66*a* and 66*b* are positioned within the compartment formed by walls 70, 72 and 75, contact plates 64*a* and 64*b* are positioned within the compartment formed by walls 70, 74 and 75 and contact plates 68*a* and 68*b* are positioned by the compartment defined under walls 72, 74 and 75. When the receptacle is mounted on the end of an electrical cord 50, each pair of contact plates receives one of the three conductors or strands of conductors 51*a*, 51*b* or 51*c* of the electrical cord there between. Alternatively, conductors or strands of conductors 51*a*, 52*b* and 51*c* may be part of another source of electricity, such as the electrical wiring of a home or the like. Contact plates 64*a* and 64*b* are secured together by screw 76, contact plates 66*a* and 66*b* are secured together by screw 78 and contact plates 68*a* and 68*b* are secured together by screw 79.

Figure 4:
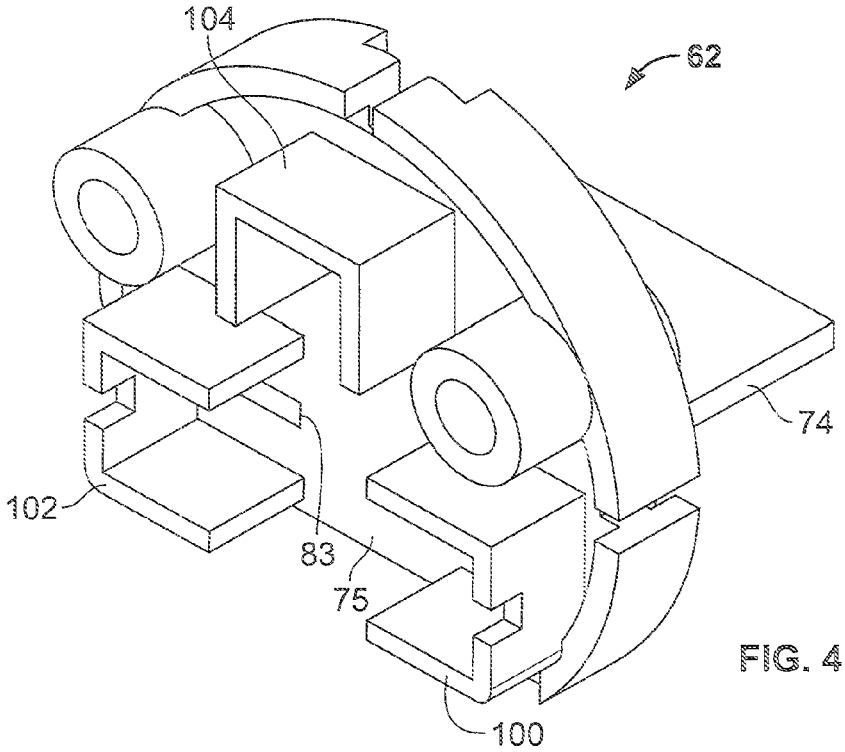
FIG. 4 is an enlarged front perspective view of the divider of the locking electrical receptacle of FIG. 3.

The divider main wall 75 features trough protrusions 80 and 82, with an opening though the main wall 75 at the bottom of each trough, an example of which may be viewed at 83 in FIG. 4. Troughs 80 and 82 receive extension 84 of contact plate 64*a* and extension 86 of contact plate 66*a*, respectively. The bifurcated connector ends 87 and 89 of each extension 84 and 86 pass through the corresponding openings through the main wall 75. A similar trough protrusion and main wall opening (not visible) are also formed for extension 88 of contact plate 68*a*.

Figure 8:
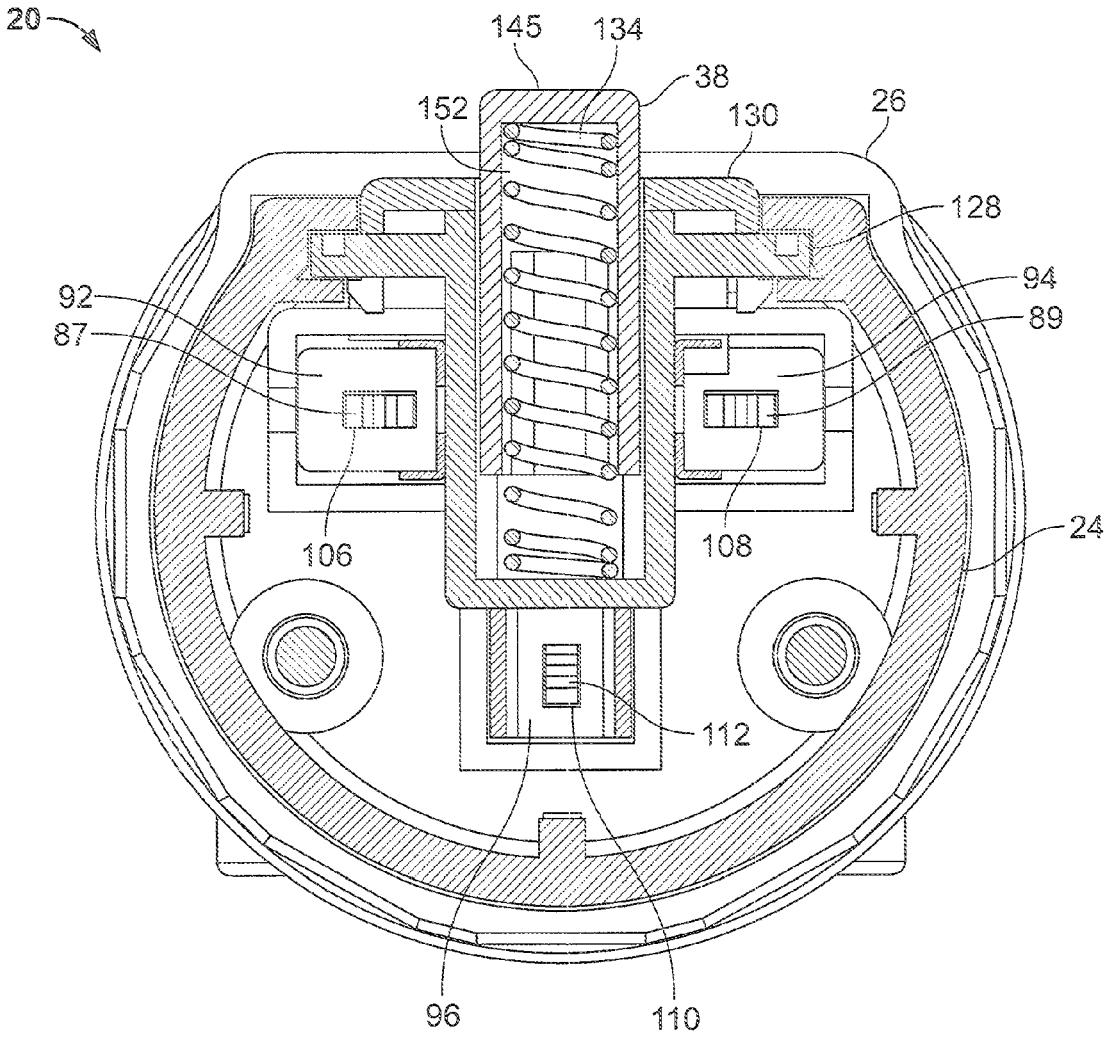
FIG. 8 is a cross sectional view of the locking electrical receptacle taken along line 8-8 of FIG. 7.

The front interior section of the housing contains the prong clips and the locking assembly. More specifically, a neutral prong clip 92, a hot prong clip 94 and a ground prong clip 96 are made from metal and are shaped so as to be attached to the divider 62 by U-shaped protrusions 100, 102 and 104, illustrated in FIG. 4, respectively. Hot prong clip 94 features opening 108 which receives bifurcated connector end 89 of contact plate 66*a* through opening 83 (FIG. 4) of divider main wall 75. The connection may be secured by soldering or other methods known in the art. As illustrated in FIG. 8, the bifurcated connector ends 87 and 112 of contact plates 64*a* and 68*a* are connected to openings 106 and 110 of the neutral prong clip and ground prong clip, respectively, in a similar fashion.

The leading ends of the neutral prong clip 92, the hot prong clip 94 and the ground prong clip 96 are positioned adjacent to the interior side of openings 30, 32 and 34 of the housing front shell 24 (FIG. 1), respectively. As illustrated in FIG. 3, the neutral prong clip 92 features a window 120 adjacent to its leading end while hot prong clip 94 features a window 122 adjacent to its leading end.

With reference to FIG. 3, the locking assembly, indicated in general at 124, includes the push button 38, a push button housing 128, a push button housing cover 130, a pair of locking balls 132*a* and 132*b* (preferably constructed of steel) and a compression coil spring 134 (also preferably constructed of steel). The push button, push button housing and push button housing cover are preferably constructed from molded plastic.

Figure 5:
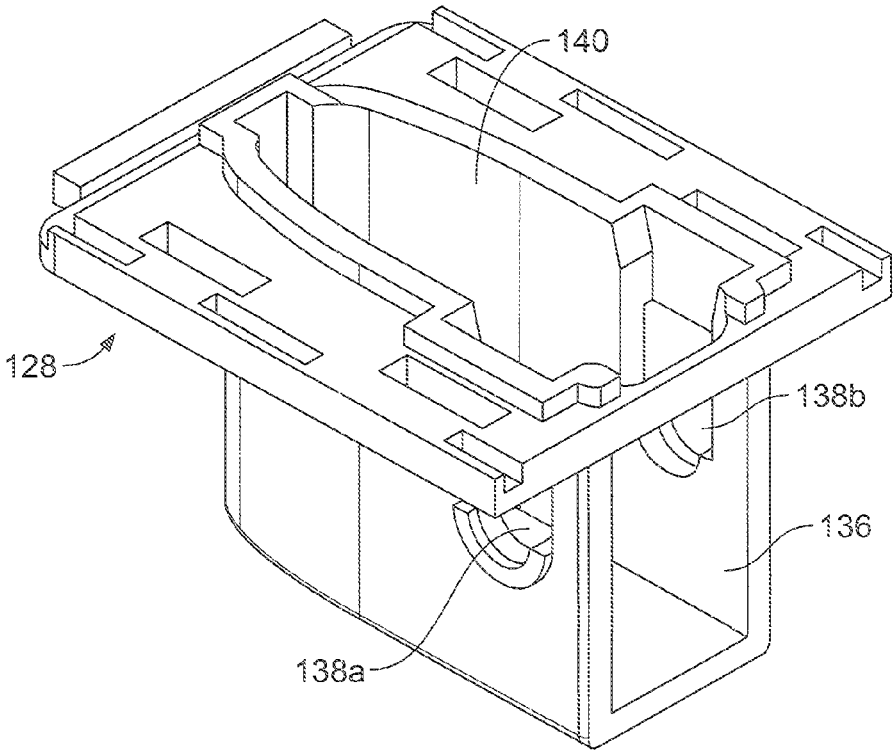
FIG. 5 is an enlarged front perspective view of the button housing of the locking electrical receptacle of FIG. 3.

As illustrated in FIG. 5, the push button housing 128 features an open front 136, a pair of locking ball sockets 138*a* and 138*b* and an interior 140.

Figure 6:
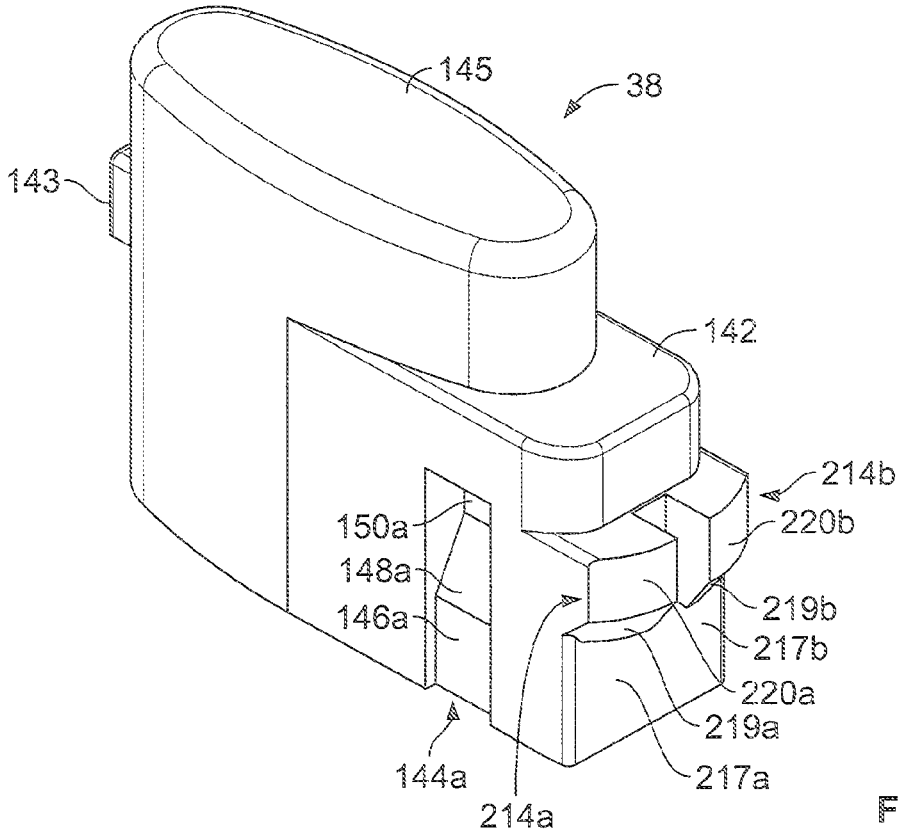
FIG. 6 is an enlarged front perspective view of the push button of the locking electrical receptacle of FIG. 3.
Figure 7:
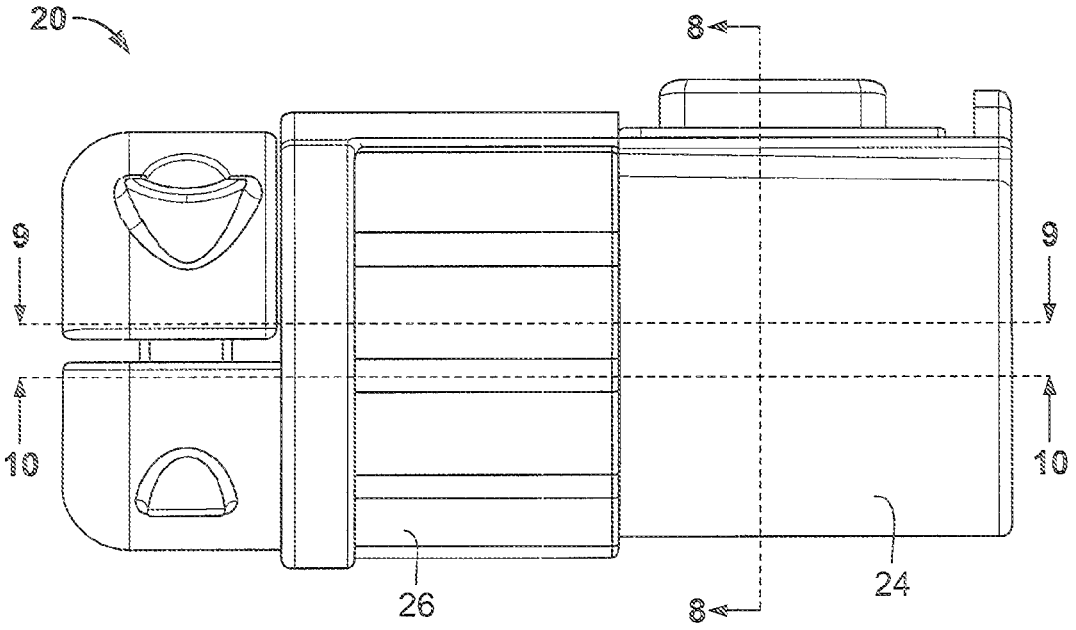
FIG. 7 is side elevational view of the locking electrical receptacle of FIGS. 1-6.

As shown in FIG. 6, the push button 38 includes a stop shoulder 142 and a stop tab 143. In addition, the push button includes a pushing surface 145 and a locking ball recess, indicated in general at 144*a*, which includes a locking surface 146*a*, a ramp surface 148*a* and an unlocking surface 150*a*. The push button features an identical locking ball recess on the opposite side.

The components of FIGS. 3-6 are shown in an assembled configuration in FIGS. 1, 2 and 7-10.

As illustrated in FIG. 8, the push button 38 features an interior bore 152 within which coil spring 134 is positioned. The bottom of the coil spring engages the bottom of push button housing 128 while the top of the coil spring engages the interior surface of the top of the push button 38. The push button housing cover 130 is secured to the push button housing 128 and upward travel of the push button 38 is limited by engagement of the push button stop shoulder 142 and the stop tab 143 (FIG. 6) with the push button housing cover 130. The pushing surface 145 of the push button protrudes out of the top of the receptacle housing so that a user may actuate the push button 38.

Figure 9:
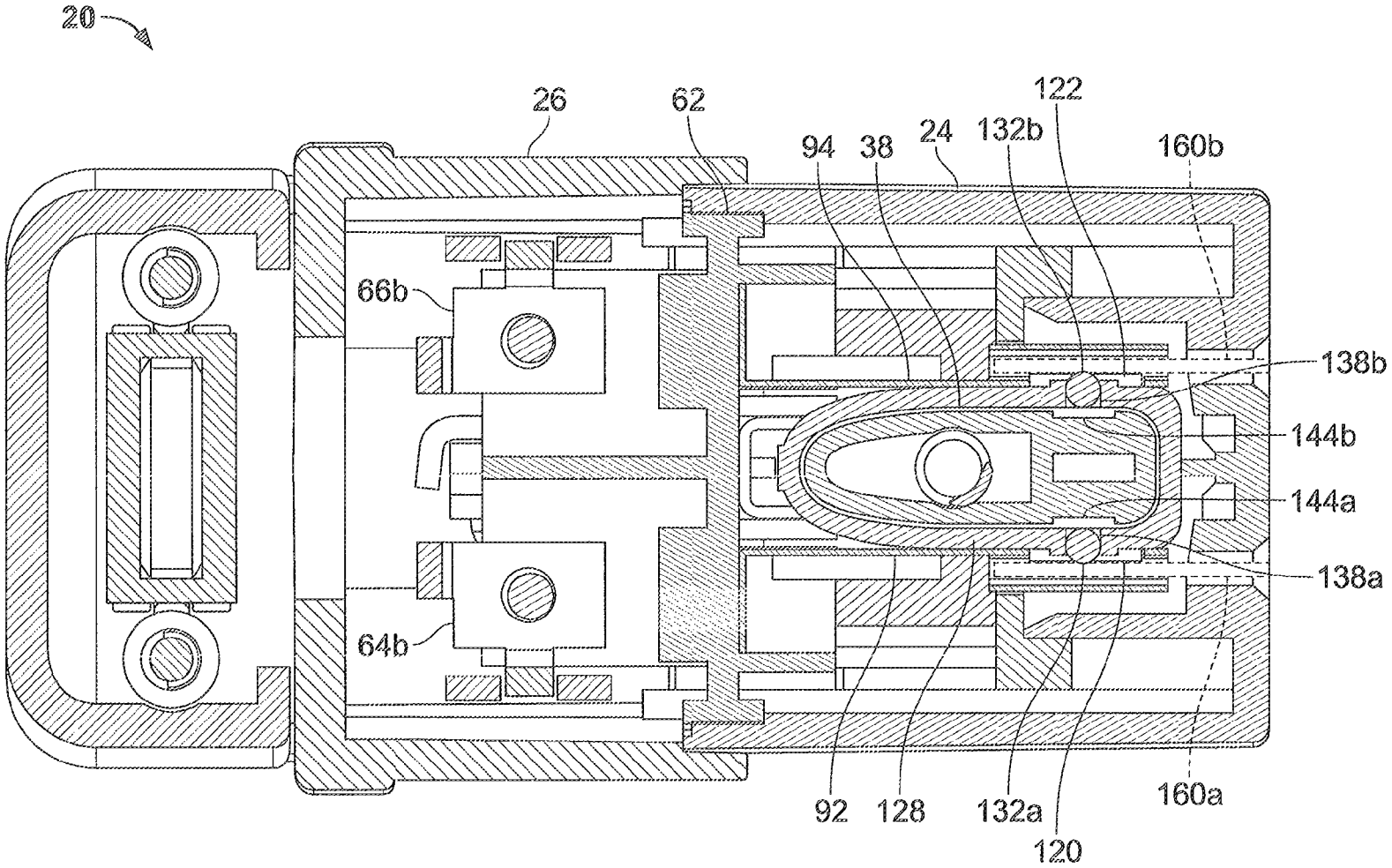
FIG. 9 is a cross sectional view of the locking electrical receptacle taken along line 9-9 of FIG. 7.
Figure 10:
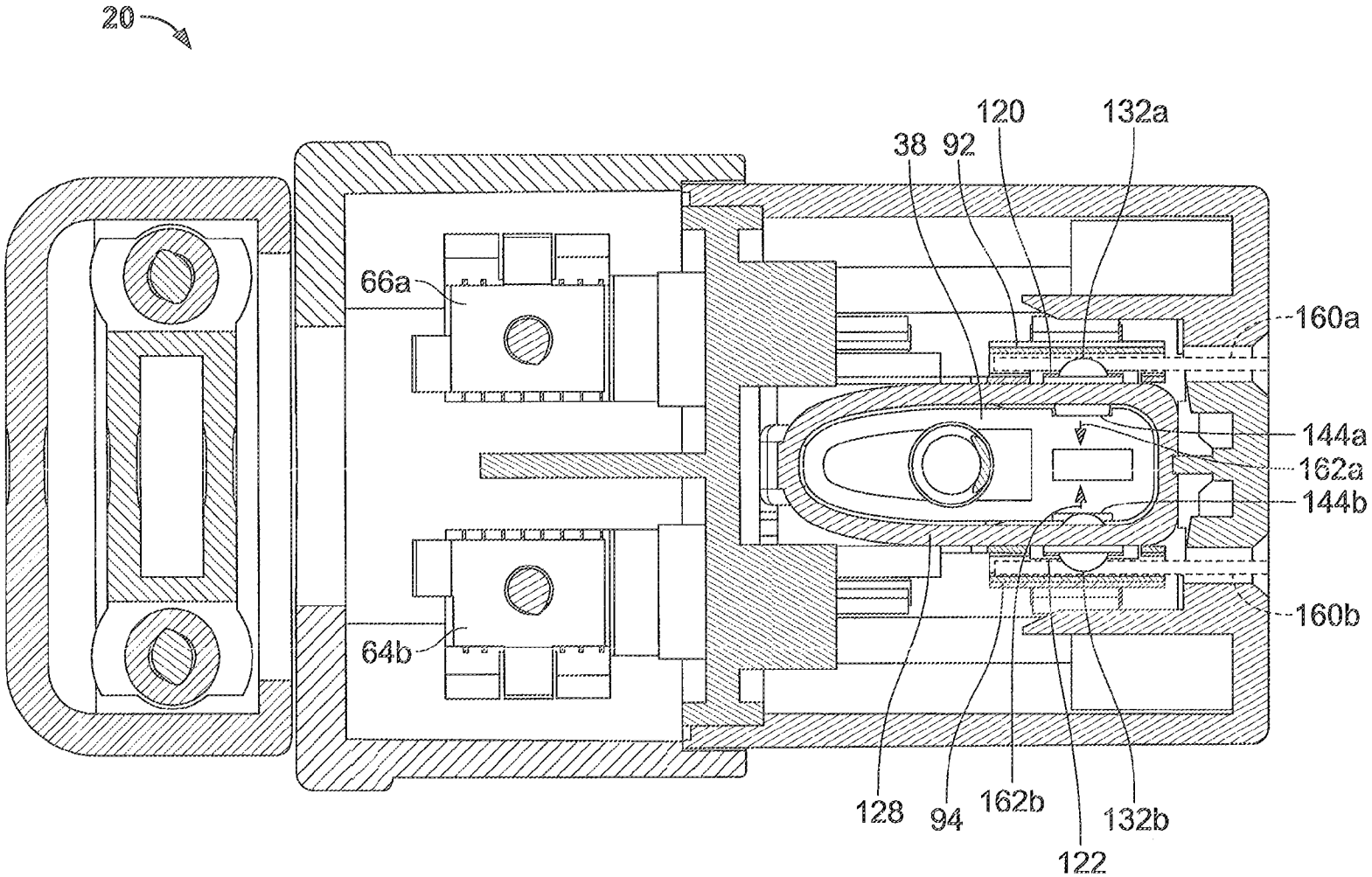
FIG. 10 is a cross sectional view of the locking electrical receptacle taken along line 10-10 of FIG. 7.

As illustrated in FIGS. 9 and 10, locking balls 132*a* and 132*b* are positioned within the locking ball recesses 144*a* and 144*b* of push button 38 and partially pass through locking ball sockets 138*a* and 138*b* of the locking ball housing 128, and the windows 120 and 122 of the prong clips 92 and 94, respectively. When male plug neutral and hot prongs, illustrated in phantom at 160*a* and 160*b* in FIGS. 9 and 10, respectively, are inserted through the slots 30 and 32 (FIG. 1) of the receptacle, the locking balls 132*a* and 132*b* engage them and lock them in the inserted position illustrated in FIGS. 9 and 10. At this point, when push button 38 is not being pressed, locking ball 132*a* is positioned on, with reference to FIG. 6, the locking surface 146*a* of the locking ball recess of the push button 38 so as to be in the extended position (with respect to the push button housing 128) illustrated in FIGS. 9 and 10. Locking ball 132*b* is positioned on a similar locking surface on the opposite side of the push button. As a result, the male plug prongs are locked within the receptacle 20.

The male plug prongs 160*a* and 160*b* of FIGS. 9 and 10 may be released by a user if he or she presses down on the pushing surface 145 (FIG. 6) of the push button 38, against the force of compression coil spring 34. Such action causes locking ball 132*a* to travel down ramp surface 148*a* (FIG. 6) to unlocking surface 150*a* as the push button 38 moves downwards. As a result, locking ball 132*a* is free to be pushed or retracted back into the push button housing 128 (arrow 162*a* of FIG. 10). Locking ball 132*b* travels in a similar fashion down its corresponding ramp surface to an unlocking surface on the opposite side of push button 38 so that it is also free to be pushed or retracted into the push button housing 128 (arrow 162*b* of FIG. 10). As a result, the male plug prongs 160*a* and 160*b* of FIGS. 9 and 10 may be withdrawn so that the male plug is removed from the receptacle 20.

A second embodiment of the locking electrical receptacle of the invention is indicated in general at 202 in FIGS. 11 and 13-16*b*. In this embodiment, the locking balls (132*a* and 132*b* of FIGS. 3, 9 and 10) have been replaced with locking springs, illustrated at 204*a* and 204*b* in FIG. 11. Other than as described below, the construction of this second embodiment is identical to the construction of the embodiment of FIGS. 1-10.

Figure 11:
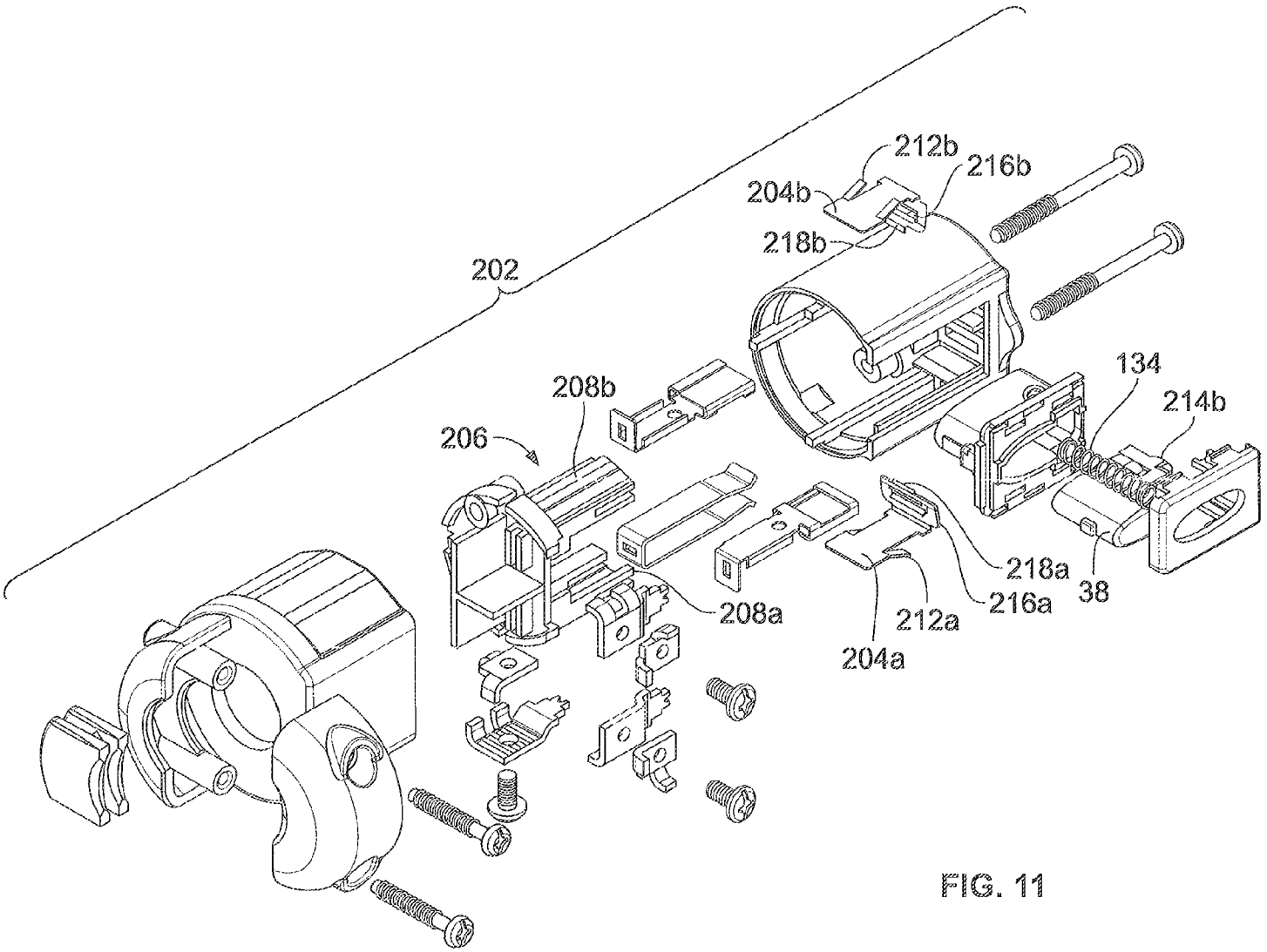
FIG. 11 is an exploded rear perspective view of a second embodiment of the locking electrical receptacle of the present invention.
Figure 12:
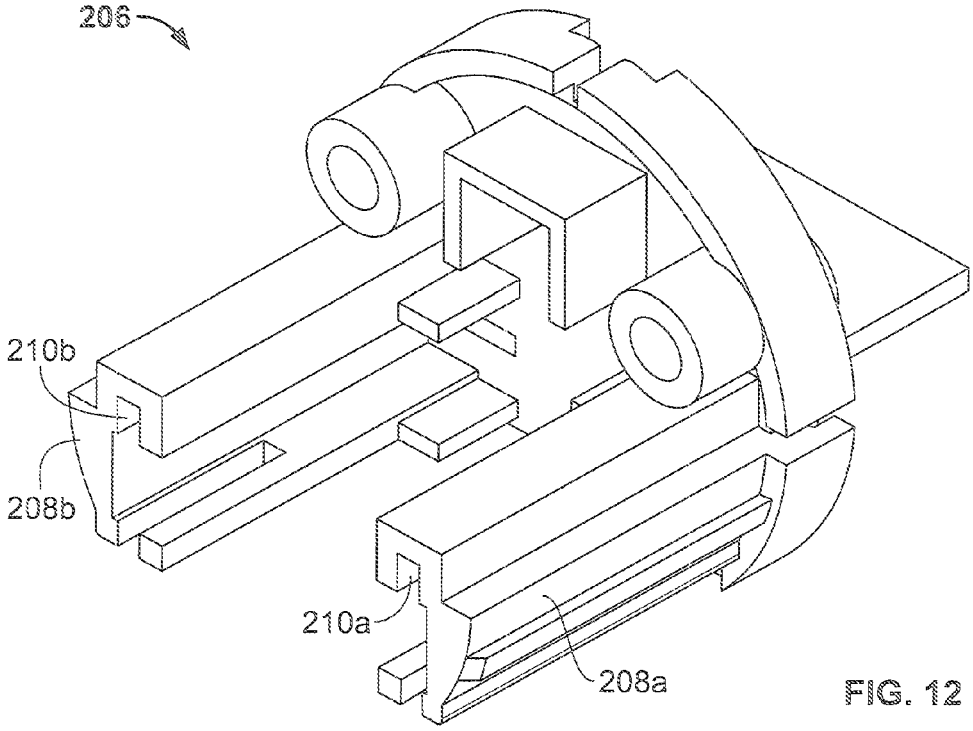
FIG. 12 is an enlarged front perspective view of the divider of the locking electrical receptacle of FIG. 11.
Figure 13:
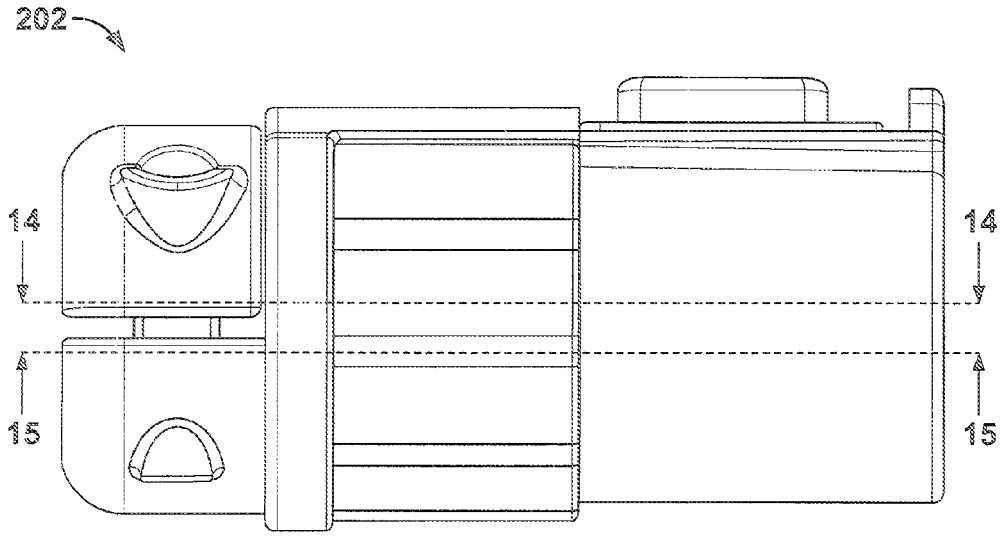
FIG. 13 is side elevational view of the locking electrical receptacle of FIGS. 11 and 12.
Figure 14A:
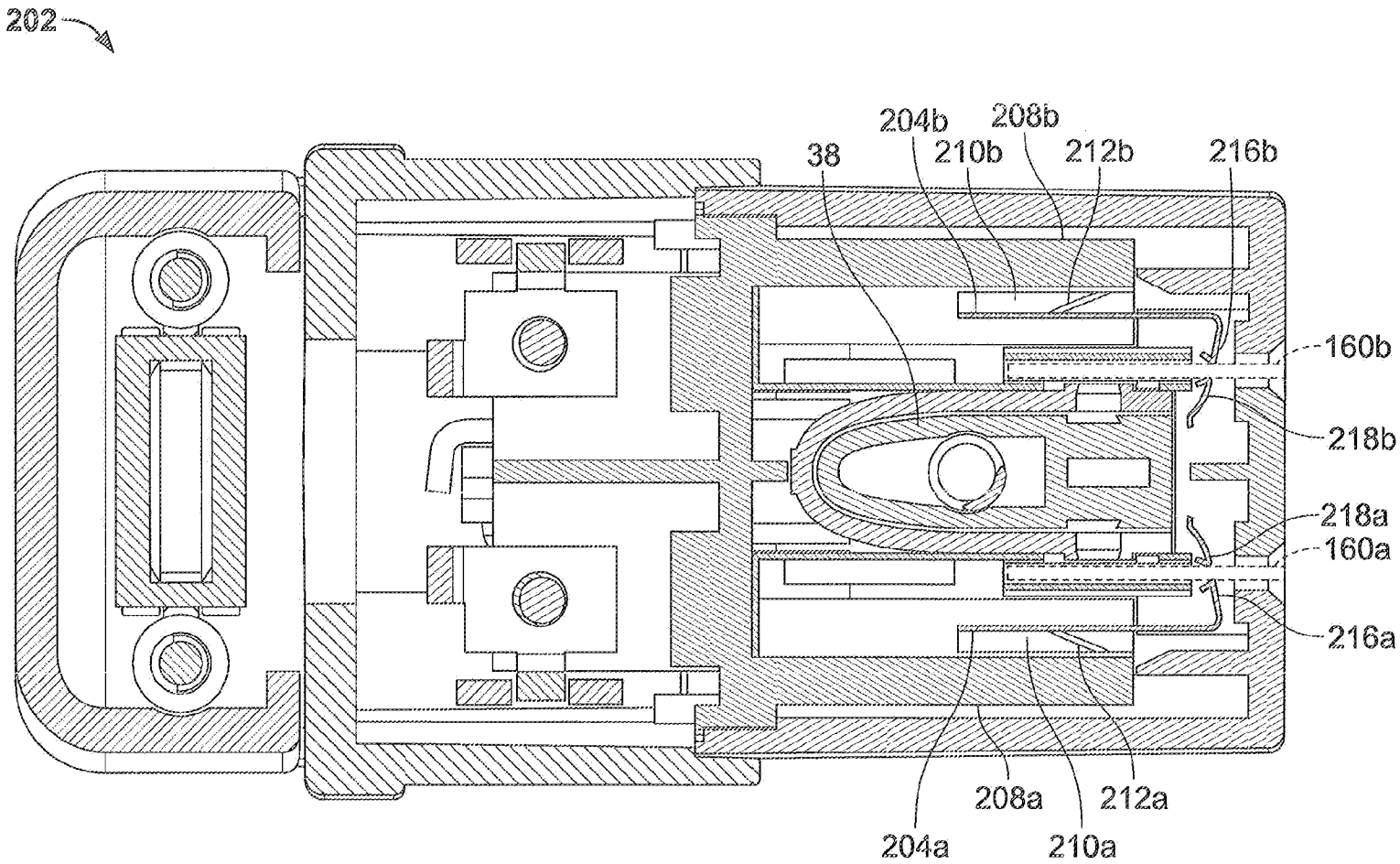
FIGS. 14A and 14B are cross sectional views of the locking electrical receptacle taken along line 14-14 of FIG. 13 showing the prongs of a male plug inserted and locked and unlocked and being removed, respectively.
Figure 14B:
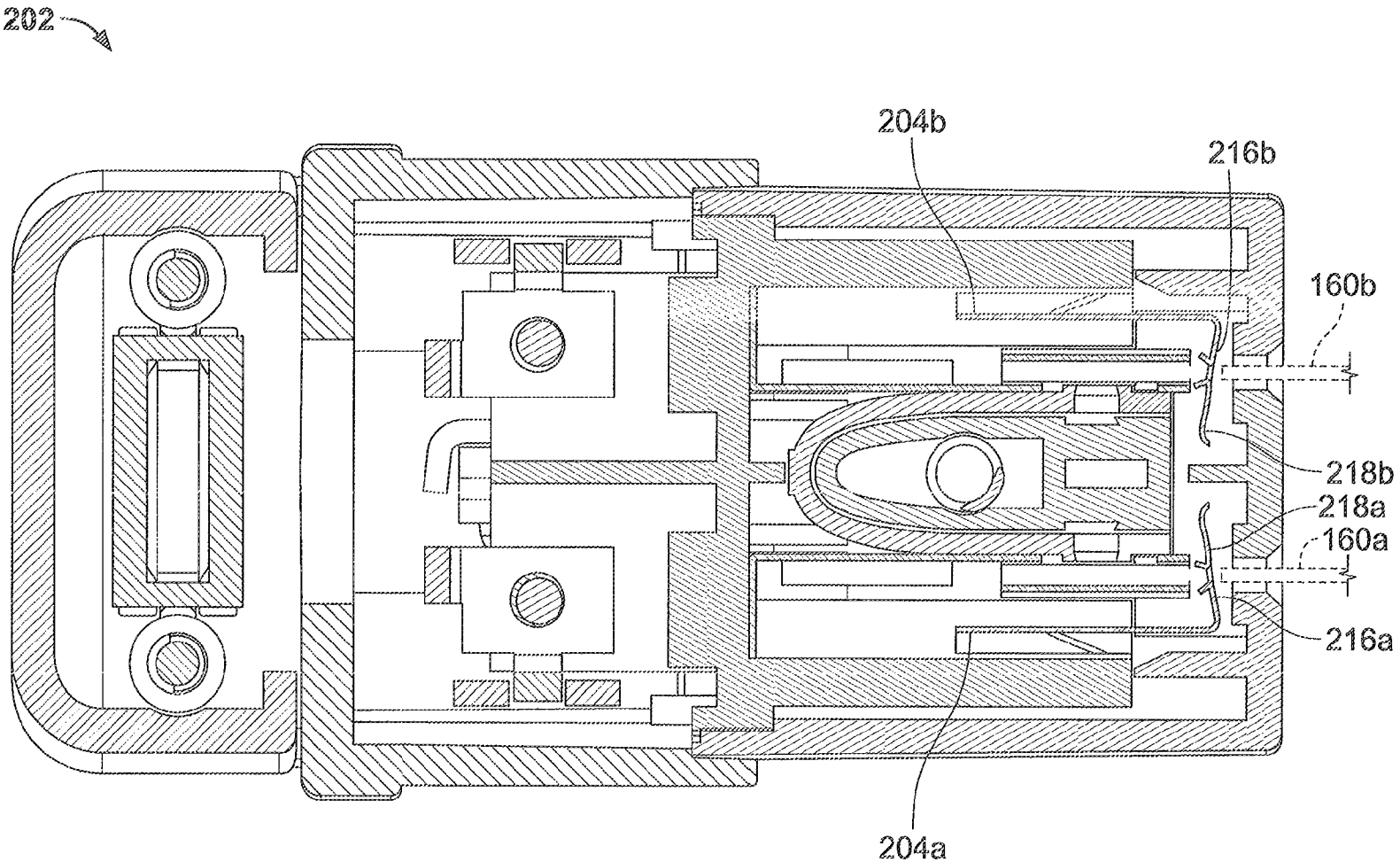

With reference to FIGS. 11 and 12, the divider 206 of the locking electrical receptacle 202 features a pair of elongated protrusions 208*a* and 208*b*. Elongated protrusions 208*a* and 208*b* have slots 210*a* and 210*b*, respectively, to receive locking springs 204*a* and 204*b*. As illustrated in FIGS. 11 and 14A, locking spring 204*a* features tabs 212*a* that engage the interior of slot 210*a* of protrusion 208*a* to secure the locking spring to the divider 206. As also illustrated in FIGS. 11 and 14A, locking spring 204*b* similarly features tabs 212*b* that engage the interior of slot 210*b* of protrusion 208*b* to secure the locking spring to the divider 206.

With reference to FIG. 6, the front of push button 38 is provided with locking wedges 214*a* and 214*b*. Locking wedge 214*a* features locking surface 217*a*, ramp surface 219*a* and unlocking surface 220*a*. Locking wedge 214*b* features locking surface 217*b*, ramp surface 219*b* and unlocking surface 220*b*. It should be noted that the locking ball recesses (144*a*) are not used in this embodiment of the locking electrical receptacle. The locking wedges 214*a* and 214*b* of FIG. 6 protrude and extend out of the open front 136 (FIG. 5) of the push button housing 128.

Figure 15A:
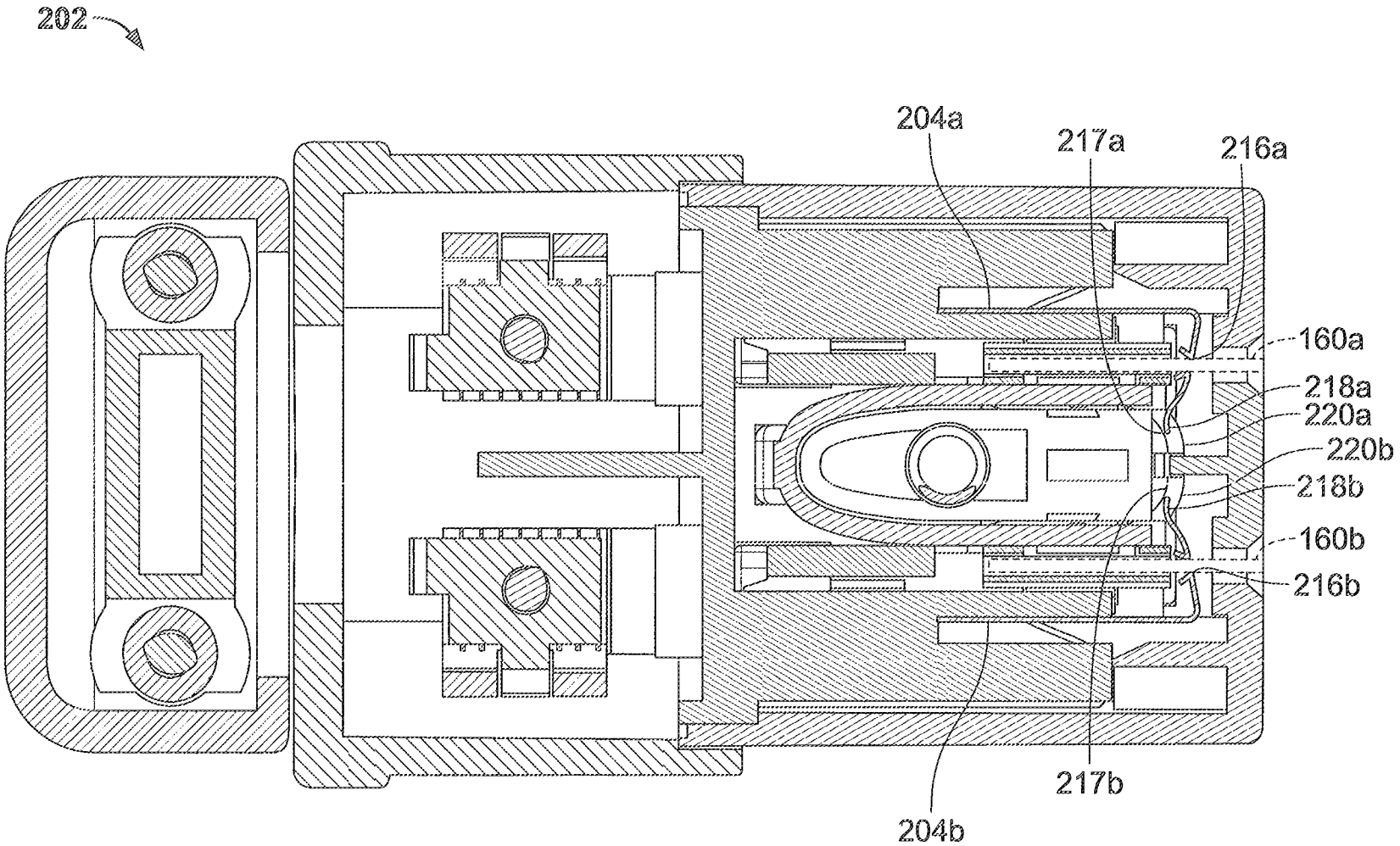
FIGS. 15A and 15B are a cross sectional views of the locking electrical receptacle taken along line 15-15 of FIG. 13 showing the prongs of a male plug inserted and locked and unlocked and being removed, respectively.
Figure 15B:
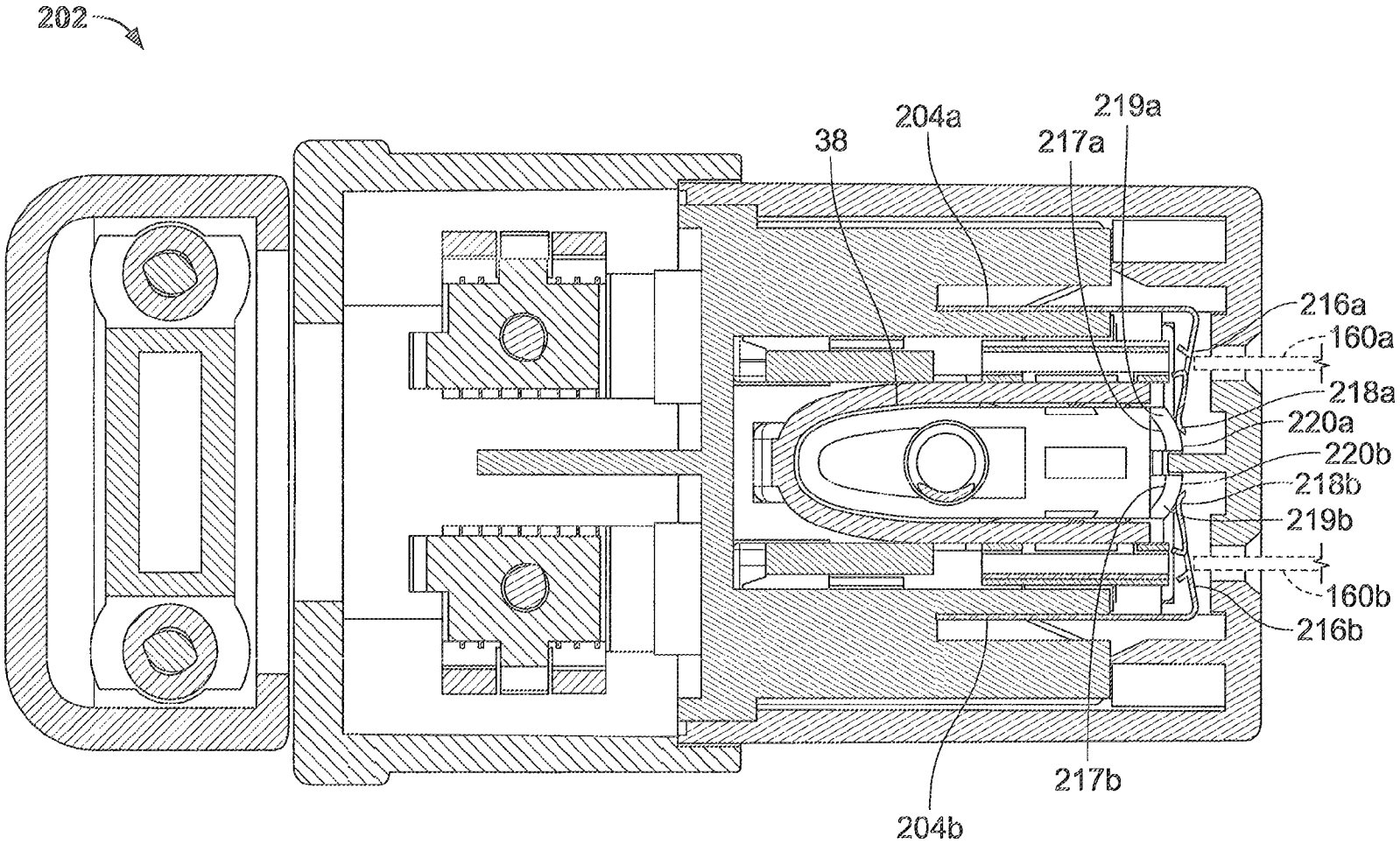

As illustrated in FIGS. 11, 14A and 15A, locking spring 204*a* features a lock opening 216*a* and an inwardly-turned distal end 218*a*, while locking spring 204*b* features a lock opening 216*b* and an inwardly-turned distal end 218*b*. When push button 38 is not being pressed, the distal ends 218*a* and 218*b* of the locking springs 204*a* and 204*b* are positioned adjacent to locking surfaces 217*a* and 217*b* (FIG. 6) of the push button and are in the positions illustrated in FIGS. 14A and 15A.

When male plug neutral and hot prongs, illustrated in phantom at 160*a* and 160*b* in FIGS. 14A and 15A, are inserted through the slots of the receptacle, the lock openings 216*a* and 216*b* of the locking springs engage them and lock them in the inserted position illustrated in FIGS. 14A and 15A. More specifically, the lock openings 216*a* and 216*b* are sized, positioned and oriented on the locking springs so that they engage, pinch and lock the male plug prongs 160*a* and 160*b* after they are inserted into the receptacle 202.

The male plug prongs 160*a* and 160*b* of FIGS. 14A and 15A may be released by a user if he or she presses down on the pushing surface 145 (FIG. 6) of the push button 38, against the force of compression coil spring 134 (FIG. 11). Such action causes the push button 38 to move downwards so that the distal ends 218*a* and 218*b* of the locking springs move (with reference to FIG. 6) up ramp surfaces 219*a* and 219*b* of the locking wedges 214*a* and 214*b* to the unlocking surfaces 220*a* and 220*b*. At this point, the locking springs 204*a* and 204*b* are in the configuration illustrated in FIGS. 14B and 15B. This causes the planes of the locking openings 216*a* and

216*b* to be more perpendicular with respect to the plane of each prong 160*a* and 160*b* so that the male plug prongs, and thus the male plug, are free to be removed from the receptacle 202.

While the preferred embodiments of the invention have been shown and described, it will be apparent to those skilled in the art that changes and modifications may be made therein without departing from the spirit of the invention, the scope of which is defined by the appended claims.

What is claimed is:

1. A locking electrical receptacle comprising:

a. a housing having first and second openings and containing first and second prong clips adapted to engage a pair of male prongs inserted through the first and second openings, said first prong clip having a first proximal end and a first distal end and said second prong clip having a second proximal end and a second distal end where the first and second distal ends are positioned adjacent to the first and second openings, respectively;

b. a push button having a pair of locking surfaces, a pair of unlocking surfaces and a pair of ramp surfaces positioned there between, said push button positioned so that the pair of locking surfaces, pair of unlocking surfaces and pair of ramp surfaces are positioned within the housing with said push button extending out of the housing;

c. a pair of locking elements positioned within the housing and movable between a locked position where the pair locking elements are adapted to lock the pair of male prongs inserted through the pair of openings in the housing and an unlocked position where the male prongs are unlocked and may be removed from the pair of openings;

d. said pair of locking elements engaging the pair of locking surfaces of the push button when in the locked position, the pair of unlocking surfaces when in the unlocked position and the pair of ramp surfaces when moving between the locked and unlocked positions;

e. a divider positioned within the housing and featuring a front side and a back side, said back side of the divider provided with a plurality of walls defining first and second contact compartments and said front side of the divider provided with first and second protrusion walls defining first and second clip recesses, said divider further including a first opening extending between the first contact compartment and the first clip recess and a second opening extending between the second contact compartment and the second clip recess;

f. said first clip recess receiving the first proximal end of the first prong clip and said second clip recess receiving the second proximal end of the second prong clip; and g. a first contact positioned within the first contact compartment and connected to the first proximal end of the first prong clip through the first opening of the divider and a second contact positioned within the second contact compartment and connected to the second proximal end of the second prong clip through the second opening of the divider, said first and second contacts adapted to be connected to a source of electricity.

2. The locking electrical receptacle of claim 1 further comprising a spring urging the push button in a direction where the pair of locking elements engage the pair of locking surfaces.

3. The locking electrical receptacle of claim 1 wherein the source of electricity is an electrical cord.

4. The locking electrical receptacle of claim 1 wherein the pair of locking elements includes a pair of locking balls.

5. The locking electrical receptacle of claim 4 further comprising a push button housing positioned within the housing, said push button housing including a pair of locking ball sockets within which the locking balls are positioned and through which they extend at least when in the locked position.

6. The locking receptacle of claim 4 wherein the push button includes a pair of locking ball recesses containing the pair of locking surfaces, unlocking surfaces and ramp surfaces.

7. The locking receptacle of claim 1 further comprising a ground prong clip positioned within the housing, where the housing has a ground opening and the ground prong clip is adapted to engage a male ground prong inserted through the ground opening.

8. The locking receptacle of claim 1 wherein each of the pair of prong clips has a window positioned adjacent to a corresponding one of the pair of locking elements and where the pair of locking elements pass through the windows when moving into the locked position.

9. The locking receptacle of claim 1 wherein the pair of locking elements include a pair of locking springs.

10. The locking receptacle of claim 9 wherein each of the pair of locking springs includes a lock opening and a distal end portion that engages the pair of locking surfaces, unlocking surfaces and ramp surfaces and where a pair of male prongs inserted through the pair of housing openings and into engagement with the pair of prong clips passes through the lock openings and are engaged by the lock openings when the locking springs are in the locked position.

11. The locking receptacle of claim 10 wherein the distal end portion is inwardly-turned with respect to the housing.

12. The locking receptacle of claim 10 wherein the push button includes a pair of locking wedges featuring the pair of locking surfaces, unlocking surfaces and ramp surfaces.

13. The locking receptacle of claim 12 wherein the locking wedges are positioned on a front surface of the push button and the distal end portion is inwardly-turned with respect to the housing so as to be engaged by the pair of locking surfaces, unlocking surfaces and ramp surfaces.

14. The locking receptacle of claim 1 wherein the first proximal end of the first prong clip features a first L-shaped section and the second proximal end of the second prong clip features a second L-shaped section where the first and second L-shaped sections are soldered to the first and second contacts, respectively.

15. The locking receptacle of claim 1 wherein the first protrusion walls defining the first clip recess form a U-shape and the second protrusion walls defining the second clip recess form a U-shape.

16. The locking receptacle of claim 1 further comprising a first trough protrusion formed on the back side of the divider and positioned over the first opening and a second trough protrusion formed on the back side of the divider and positioned over the second opening with the first contact engaging the first trough protrusion and the second contact engaging the second trough protrusion.

17. A locking electrical receptacle comprising:

a. a housing defining an interior chamber having first and second openings;

b. first and second prong clips, said first prong clip having a first proximal end and a first distal end and said second prong clip having a second proximal end and a second distal end and said first and second prong clips positioned within the interior chamber of the housing with the first distal end positioned adjacent to an interior side of the first opening and the second distal end positioned adjacent to an interior side of the second opening;

c. a locking assembly positioned in the housing and including:

i) a push button extending out of the housing, said push button including a pushing surface positioned external to the housing and a first locking surface and a first unlocking surface with a first ramp surface there between positioned within the interior chamber, and a second locking surface and a second unlocking surface with a second ramp surface there between positioned within the interior chamber;

ii) a first locking element movable between a locked position where the first locking element is adapted to lock a first male prong inserted into the first prong clip and an unlocked position where the first male prong is unlocked so that it may be removed from the first prong clip;

iii) a second locking element movable between a locked position where the second locking element is adapted to lock a second male prong inserted into the second prong clip and an unlocked position where the second male prong is unlocked so that it may be removed from the second prong clip;

iv) said first locking element engaging the first locking surface of the push button when in the locked position, the first unlocking surface when in the unlocked position and the first ramp surface when moving between the locked and unlocked positions;

v) said second locking element engaging the second locking surface of the push button when in the locked position, the second unlocking surface when in the unlocked position and the second ramp surface when moving between the locked and unlocked positions;

d. a divider positioned within the housing and featuring a front side and a back side, said back side of the divider provided with a plurality of walls defining first and second contact compartments and said front side of the divider provided with first and second protrusion walls defining first and second clip recesses, said divider further including a first opening extending between the first contact compartment and the first clip recess and a second opening extending between the second contact compartment and the second clip recess;

e. said first clip recess receiving the first proximal end of the first prong clip and said second clip recess receiving the second proximal end of the second prong clip; and f. a first contact positioned within the first contact compartment and connected to the first proximal end of the first prong clip through the first opening of the divider and a second contact positioned within the second contact compartment and connected to the second proximal end of the second prong clip through the second opening of the divider, said first and second contacts adapted to be connected to a source of electricity.

18. The locking electrical receptacle of claim 17 further comprising a spring urging the push button in a direction where the first and second locking elements engage the first and second locking surfaces.

19. The locking electrical receptacle of claim 17 wherein the source of electricity is an electrical cord.

20. The locking electrical receptacle of claim 17 wherein the first and second locking elements include first and second locking balls.

21. The locking electrical receptacle of claim 20 further comprising a push button housing positioned within the housing, said push button housing including first and second locking ball sockets within which the first and second locking balls are respectively positioned and through which they extend at least when in the locked position.

22. The locking receptacle of claim 17 wherein the push button includes first and second locking ball recesses containing the first and second locking surfaces, the first and second unlocking surfaces and the first and second ramp surfaces.

23. The locking receptacle of claim 17 further comprising a ground prong clip positioned within the housing, where the housing has a ground opening and the ground prong clip is adapted to engage a male ground prong inserted through the ground opening.

24. The locking receptacle of claim 17 wherein each of the first and second prong clips has a window positioned adjacent to a corresponding one of the first and second locking elements and where the first and second locking elements pass through the windows when moving into the locked position.

25. The locking receptacle of claim 17 wherein the first and second locking elements include first and second locking springs.

26. The locking receptacle of claim 25 wherein each of the first and second locking springs includes a lock opening and a distal end portion that engages the first and second locking surfaces, unlocking surfaces and ramp surfaces respectively and where first and second male prongs inserted through the first and second housing openings and into engagement with the first and second prong clips passes through the lock openings and are engaged by the lock openings when the first and second locking springs are in the locked position.

27. The locking receptacle of claim 26 wherein the distal end portions are inwardly-turned with respect to the housing.

28. The locking receptacle of claim 26 wherein the push button includes a pair of locking wedges featuring the pair of locking surfaces, unlocking surfaces and ramp surfaces.

29. The locking receptacle of claim 28 wherein the locking wedges are positioned on a front surface of the push button and the distal end portion is inwardly-turned with respect to the housing so as to be engaged by the pair of locking surfaces, unlocking surfaces and ramp surfaces.

30. The locking receptacle of claim 17 wherein the first proximal end of the first prong clip features a first L-shaped section and the second proximal end of the second prong clip features a second L-shaped section where the first and second L-shaped sections are soldered to the first and second contacts, respectively.

31. The locking receptacle of claim 17 wherein the first protrusion walls defining the first clip recess form a U-shape and the second protrusion walls defining the second clip recess form a U-shape.

32. The locking receptacle of claim 17 further comprising a first trough protrusion formed on the back side of the divider and positioned over the first opening and a second trough protrusion formed on the back side of the divider and positioned over the second opening with the first contact engaging the first trough protrusion and the second contact engaging the second trough protrusion.

* * * * *